US007958743B2

(12) United States Patent
Lee et al.

(10) Patent No.: US 7,958,743 B2
(45) Date of Patent: Jun. 14, 2011

(54) REFRIGERATOR

(75) Inventors: Youn Seok Lee, Seoul (KR); Su Nam Chae, Seoul (KR)

(73) Assignee: LG Electronics Inc., Seoul (KR)

( * ) Notice: Subject to any disclaimer, the term of this patent is extended or adjusted under 35 U.S.C. 154(b) by 414 days.

(21) Appl. No.: 12/146,249

(22) Filed: Jun. 25, 2008

(65) Prior Publication Data

US 2009/0015123 A1 Jan. 15, 2009

(30) Foreign Application Priority Data

Jul. 11, 2007 (KR) ..... 10-2007-0069680

(51) Int. Cl.
*F25D 17/04* (2006.01)

(52) U.S. Cl. ..... 62/407; 62/419

(58) Field of Classification Search ..... 62/407, 62/408, 419, 443, 411, 413, 186, 418, 529.1, 62/259.1; 454/186, 236, 347; 312/116, 128, 312/130

See application file for complete search history.

(56) References Cited

U.S. PATENT DOCUMENTS

| | | | | |
|---|---|---|---|---|
| 2,943,455 | A | 7/1960 | Reverman, Jr. | |
| 2,994,207 | A | 8/1961 | Preotle et al. | |
| 3,122,005 | A * | 2/1964 | Costantini et al. | 62/419 |
| 3,495,416 | A * | 2/1970 | Bottoms et al. | 62/155 |
| 3,976,122 | A * | 8/1976 | Neidhardt | 165/265 |
| 4,638,644 | A * | 1/1987 | Gidseg | 62/329 |
| 4,722,200 | A * | 2/1988 | Frohbieter | 62/382 |
| 4,914,928 | A * | 4/1990 | Fellwock et al. | 62/408 |
| 4,924,680 | A * | 5/1990 | Janke et al. | 62/187 |
| 5,355,686 | A * | 10/1994 | Weiss | 62/89 |
| 5,490,395 | A * | 2/1996 | Williams et al. | 62/187 |
| 6,055,820 | A * | 5/2000 | Jeong et al. | 62/186 |
| 6,990,828 | B2 * | 1/2006 | Kim et al. | 62/381 |
| 2005/0217307 | A1 | 10/2005 | Kim et al. | |
| 2006/0163985 | A1 | 7/2006 | Blersch et al. | |

FOREIGN PATENT DOCUMENTS

| | | | |
|---|---|---|---|
| EP | 1 605 217 | A2 | 12/2005 |
| JP | 2002-295949 | A | 10/2002 |

* cited by examiner

*Primary Examiner* — Mohammad Ali
(74) *Attorney, Agent, or Firm* — Birch, Stewart, Kolasch & Birch, LLP

(57) ABSTRACT

A refrigerator including a bulkhead partitioning an inner space of the refrigerator, a duct part provided to the bulkhead to guide a cold air to the inner space of the refrigerator, at least one rack configured to divide the inner space partitioned by the bulkhead into sub-spaces, the at least one rack configured to support an object to be stored, and at least one support part provided in one of the bulkhead and the duct part to support the rack.

16 Claims, 6 Drawing Sheets

REFRIGERATOR

CROSS REFERENCE TO RELATED APPLICATIONS

This application claims the benefit of the Korean Patent Application No. 10-2007-0069680, filed on Jul. 11, 2007, which is hereby incorporated by reference as if fully set forth herein.

BACKGROUND OF THE INVENTION

1. Field of the Invention

The present invention relates to a refrigerator and more particularly to stably supporting a rack in the refrigerator despite a duct provided to a bulkhead.

2. Discussion of the Related Art

Generally, a refrigerator is a device divided into a cool chamber and a freezing compartment to store or keep food. The cool chamber is maintained at about 3~4° C. to store food and/or vegetables fresh for a long term, while the freezing compartment is maintained below 0° C. to keep meat, food, and the like in a frozen state.

A related art refrigerator includes a freezing compartment door and a cool chamber door to open/close a freezing compartment and a cool chamber, respectively. Further, an evaporator is provided within a backside wall of the freezing compartment or the cool chamber, and a cold air duct is provided thereto. Thus, cold air is supplied via a cold air hole provided along the duct. In this configuration, a slidable rack is provided for smooth distribution of the cold air and installation facilitation.

In addition, when the cold air duct is provided in a rear part of the refrigerator, rack supports may be provided in sidewalls. However, if the evaporator and the duct are provided in a middle bulkhead, it is difficult to install the rack supports.

SUMMARY OF THE INVENTION

Accordingly, one object of the present invention is to provide a refrigerator that substantially obviates one or more problems due to limitations and disadvantages of the related art.

Another object of the present invention is to provide a refrigerator, by which a conflict between positions of a cold air duct and a cold air hole can be avoided.

To achieve these objects and other advantages and in accordance with the purpose of the invention, as embodied and broadly described herein, the present invention provides in one aspect a refrigerator included a bulkhead partitioning an inner space of the refrigerator, a duct part provided in the bulkhead to guide a cold air to the inner space of the refrigerator, at least one rack configured to divide the inner space partitioned by the bulkhead into sub-spaces, the at least one rack configured to support an object to be stored, and at least one support part provided in the at least one selected from the group consisting of the bulkhead and the duct part to support the rack.

In another aspect, the present invention provides a refrigerator including a duct part provided in a bulkhead partitioning an inner space of the refrigerator to guide a cold air to the inner space of the refrigerator, a plurality of cold air holes provided in an outer wall of the duct part to be spaced apart from each other in a vertical direction and to enable the cold air to be discharged, and at least one hanging member provided in the bulkhead and/or the outer wall of the duct part to enable a rack to be supported between the cold air holes neighbor to each other, wherein an object to be supported is put on the rack.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The accompanying drawings, which are included to provide a further understanding of the invention and are incorporated in and constitute a pair of this application, illustrate embodiment(s) of the invention and together with the description serve to explain the principle of the invention. In the drawings.

DETAILED DESCRIPTION OF THE INVENTION

Figure 1:
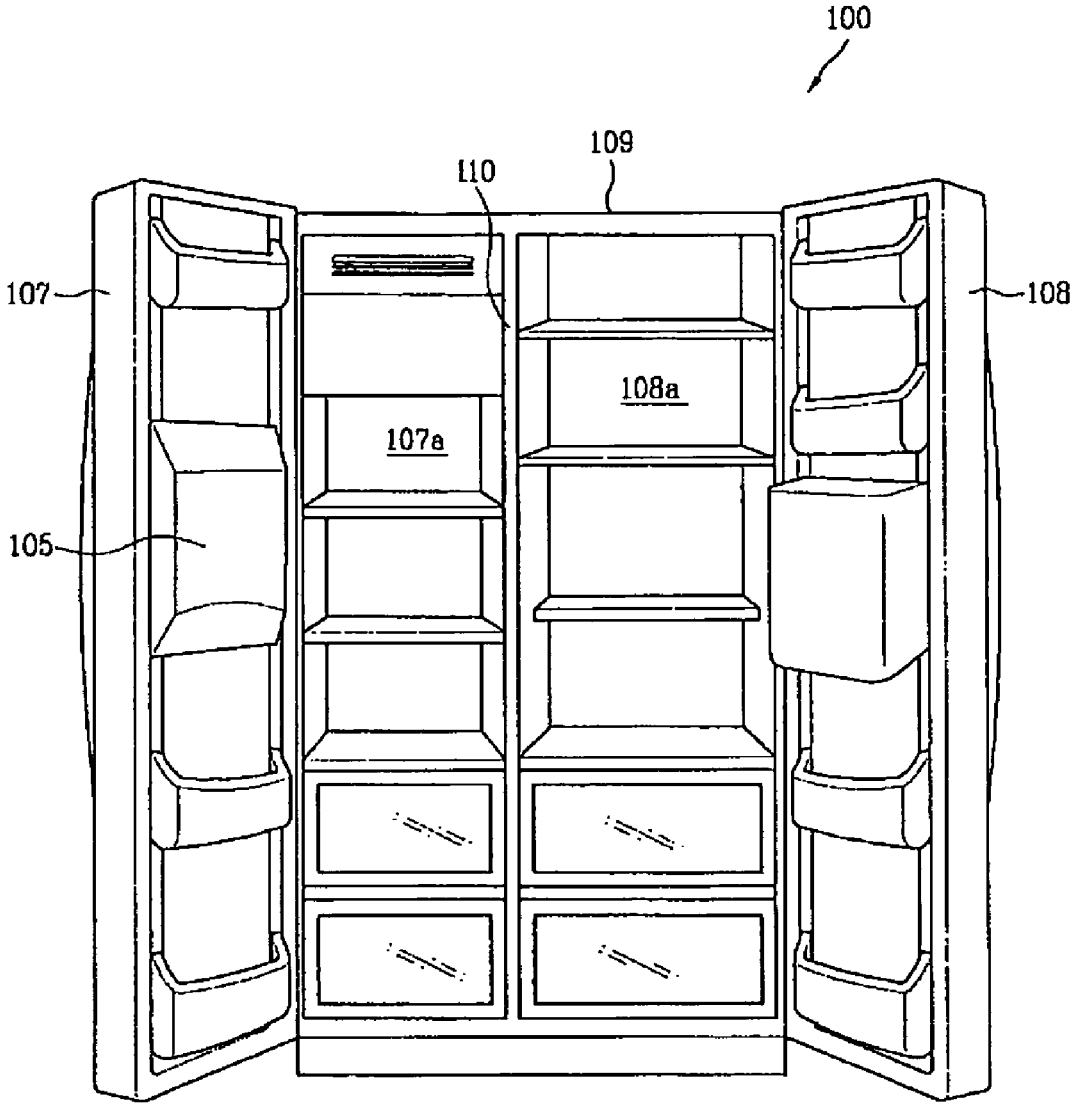
FIG. 1 is a perspective diagram of a refrigerator according to an embodiment of the present invention, which shows a state that a cool chamber door and a freezing compartment door are open.

Reference will now be made in detail to the preferred embodiments of the present invention, examples of which are illustrated in the accompanying drawings. Wherever possible, the same reference numbers will be used throughout the drawings to refer to the same or like parts.

Referring to FIGS. 1 to 4, a refrigerator 100 according to an embodiment of the present invention includes a bulkhead 110 partitioning an inner space of the refrigerator 100, a duct part 120 provided in the bulkhead 110 to guide cold air to the inner space of the refrigerator 100, at least one rack 130 dividing a space partitioned by the bulkhead 110 into smaller spaces to support an object to be stored thereon, and at least one or more support parts provided in the bulkhead 110 and/or the duct part 120.

The refrigerator 100 includes a refrigerator body 109 having a freezing compartment 107*a* and a cool chamber 108*a* to keep an object in a user-specific state, a refrigerator door 107 provided in one side of the refrigerator body 109 to selectively open/close the freezing compartment 107*a*, and another refrigerator door 108 provided in the other side of the refrigerator 100 to selectively open/close the cool chamber 108*a*.

For instance, the freezing compartment 107*a* is provided in a left space of the refrigerator body 109, while the cool chamber 108*a* is provided in a right space of the refrigerator body 109. In particular, the freezing compartment door 107 and the cool chamber door 108 are provided in a front side of the refrigerator body 109 to selectively open/close the freezing compartment 107*a* and the cool chamber 108*a*, respectively.

However, is understood that positions of the freezing compartment door and the cool chamber door depend on those of the freezing compartment and the cool chamber, respectively. For instance, the refrigerator may include one of a top-mount type refrigerator, a 3-door type refrigerator having two doors provided in an upper part and a slidable door provided to a lower part, and the like.

In addition, a dispenser 105 is provided in a front side of the freezing compartment door 107 to facilitate a user to retrieve water or ice without opening the corresponding door 107. An icemaker (not shown) for making ice and a water tank (not shown) for storing water therein are provided in one side of the inner space of the refrigerator 100.

Further, bulkhead 110 can partition the inner space of the refrigerator body 109 into the freezing compartment 107*a* and the cool chamber 108*a*. As shown, the bulkhead 110 is vertically provided in a middle part of the refrigerator 100 to partition the inner space of the refrigerator 100 into the freezing compartment 107*a* and the cool chamber 108*a* centering on the bulkhead 110, which corresponds to a 2-door type configuration.

Further, an evaporator 102 is provided in the bulkhead 110 to generate cold air. The evaporator 102 is sequentially connected to a compressor (not shown), a condenser (not shown) and an expansion valve (not shown) to construct a cooling cycle. In this instance, the cold air is generated in a manner that a refrigerant circulating in the cooling cycle evaporates in the evaporator 102 to absorb heat. Alternatively, the evaporator 102 may be provided in a backside of the refrigerator 100.

The duct part 120 is provided in the bulkhead 110 to guide the cold air to the inner space of the refrigerator 100. In particular, the cold air generated from the evaporator 102 flows via the duct part 120. In addition, at least one cold air hole 122 is provided in an outer wall of the duct part 120 to discharge the cold air. The outer wall of the duct part 120 is configured to protrude outward from the bulkhead 110 to a prescribed length. In particular, the outer wall of the duct part 120 constructs a portion of an exterior of the bulkhead 110 to protrude outward.

The at least one cold air hole 122 is provided in the outer wall of the duct part 120 to discharge the cold air into the cool chamber 108*a* or the freezing compartment 107*a*. Further, at least one or more cold air holes 122 are grouped into a plurality of groups, each of which includes a prescribed number of the cold air holes 122. Thus, a plurality of the groups can be arranged in a vertical direction to be uniformly spaced apart from each other.

In addition, the rack 130 is provided in generate a plurality of accommodating spaces by dividing the partitioned space according to the bulkhead 110 into a plurality of smaller sub-spaces. Also, the rack 130 plays a role in supporting an object to be stored in the refrigerator 100. Further, the object to be stored can be accommodated in one of various storage containers in accordance with a selection made by a user.

Figure 2:
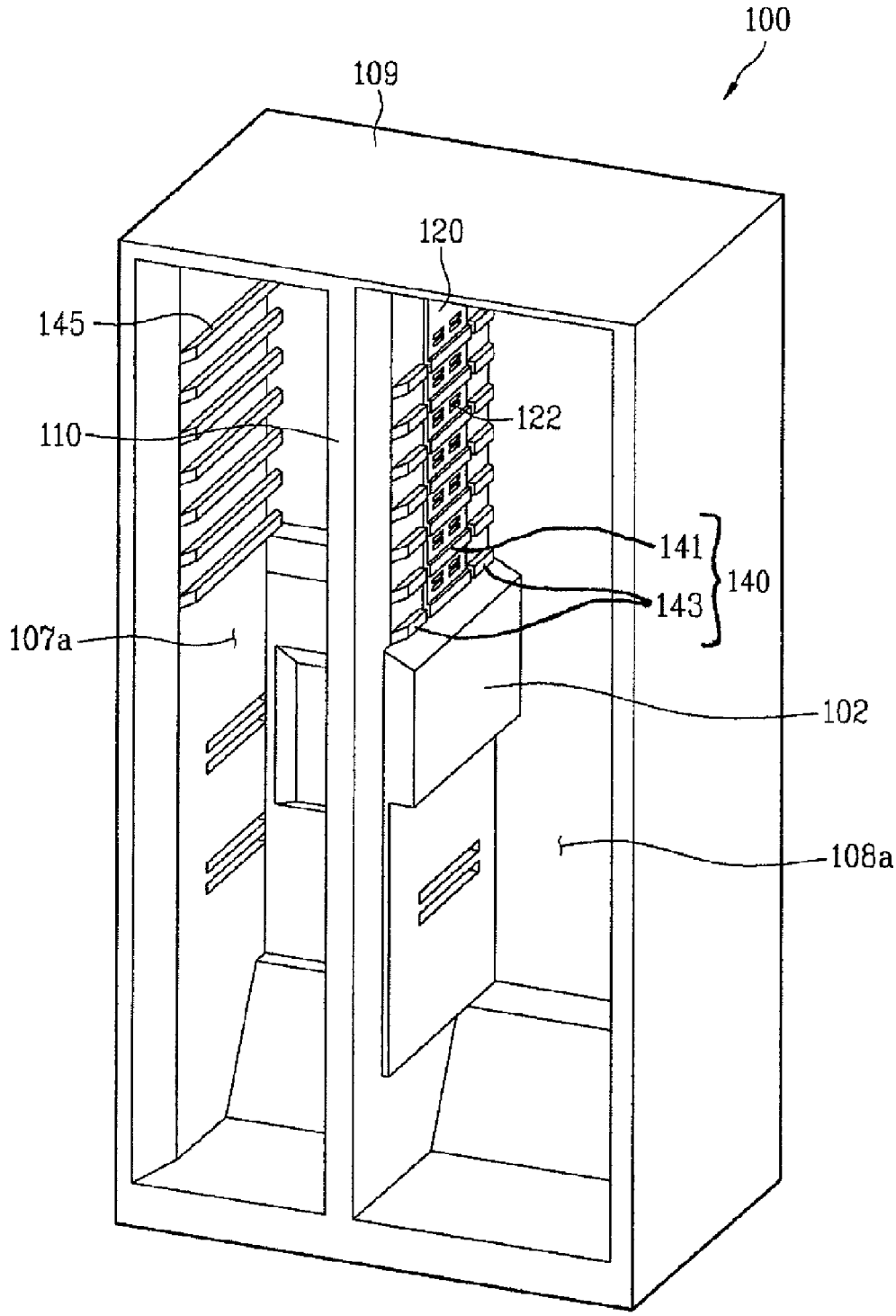
FIG. 2 is a perspective diagram of a refrigerator according to an embodiment of the present invention, which shows an inner configuration of the refrigerator.
Figure 3:
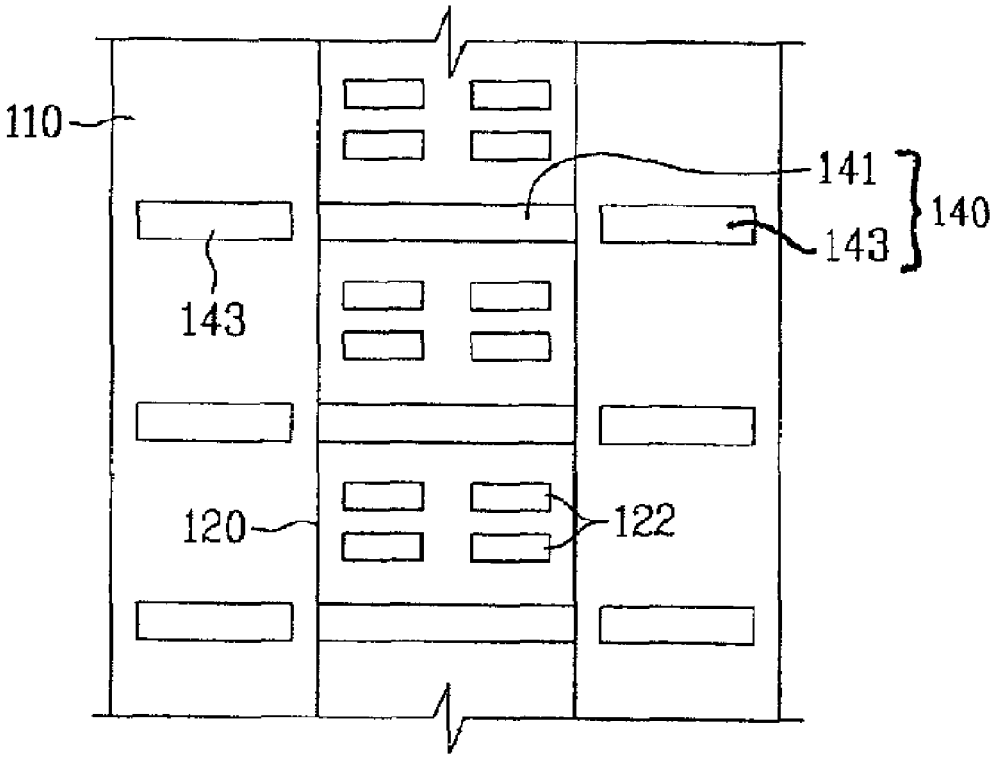
FIG. 3 is a layout for an arrangement configuration of a support part of a refrigerator according to an embodiment of the present invention.
Figure 4:
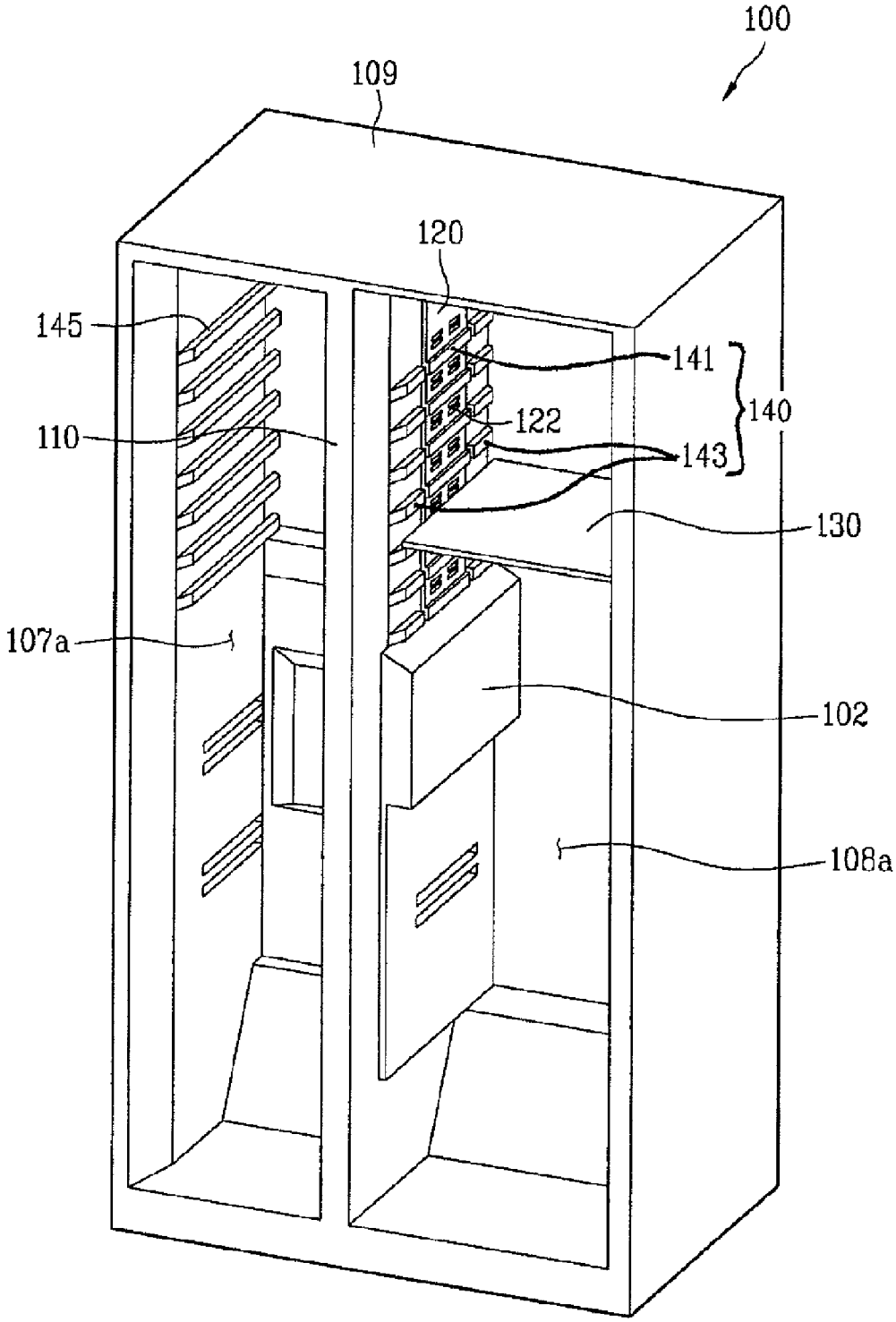
FIG. 4 is a perspective diagram of a refrigerator according to an embodiment of the present invention, which shows a rack installed within the refrigerator.

To support the rack 130, the refrigerator 100 according to an embodiment of the present invention further includes at least one support part provided in the bulkhead 110 and/or the duct part 120. The support part 140, as shown in FIGS. 2 to 4, includes at least one first hanging member 141 provided in the outer wall of the duct part 120 to support a side portion of the rack 130 and at least one second hanging member 143 provided in the bulkhead 110 to support the side portion of the rack 130. Further, the first hanging member 141 is configured to be outwardly projected from the outer wall of the duct part 120 to a predetermined length. Also, one side portion off the rack 130 can be supported by the projected first hanging member 141.

Preferably, the first hanging member 141 is configured parallel with an installation plane. The first hanging member 141 can be provided in a portion of the outer wall of the duct part 120 in a horizontal direction. Optionally, the first hanging member 141 can be provided in a whole part of the duct part 120 in a horizontal direction.

The second hanging member 143 is provided in the bulkhead 110. Preferably, a pair of the second hanging members 143 can be provided in the bulkhead 110, and more particularly, both sides of the bulkhead 110 divided centering on the duct part 120.

In addition, the second hanging member 143 is configured to be outwardly projected from the bulkhead 110 to a predetermined length to support one side portion of the rack 130. Preferably, the second hanging member 143 is provided parallel with the installation plane.

According to an embodiment of the present invention, because the duct part 120 is configured to protrude outwardly from the bulkhead 110, the first and second hanging members 141 and 143 differ from each other in starting points. Preferably, the first and second hanging members 141 and 143 are configured to be projected to a same length with reference to the bulkhead 110. In this instance, the first hanging member 141 provided in the outer wall of the duct part 120 is configured to be projected relatively shorter than the second hanging member 143.

Preferably, the first and second hanging members 141 and 143 are configured to substantially form a straight line in a front-to-rear direction within the refrigerator 100. Therefore, the first and second hanging members 141 and 143, which are located to oppose each other, are positioned at the same height from the installation plane to support the same side portion of the rack 130.

A third hanging member 145 is provided in an inner wall of the refrigerator opposing the side where the first and second hanging members 141 and 143 are formed. Thus, the third hanging member 145 plays a role in supporting the other side portion of the rack 130. Preferably, the third hanging member 145 is provided in a same level of the corresponding first/second hanging members 141/143.

In addition, the cold air hole 122 can be provided between the first hanging members 141 neighboring to each other on the duct part 120. In particular, although both of the first hanging member 141 and the cold air hole 122 are provided in the outer wall of the duct part 120, they are configured to alternate with each other in a vertical direction. Hence, the first hanging member 141 and the cold air hole 122 avoid being overlapped with each other.

Further, first and second hanging members 141 and 143 can be provided in each of the cool chamber 107*a* and the freezing compartment 108*a*. Also, the first and second hanging members 141 and 143 can be configured symmetric in the cool chamber 107*a* and the freezing compartment 108*a*. The third hanging members 145 are also provided in both inner walls opposing the bulkhead 110, respectively.

Figure 5:
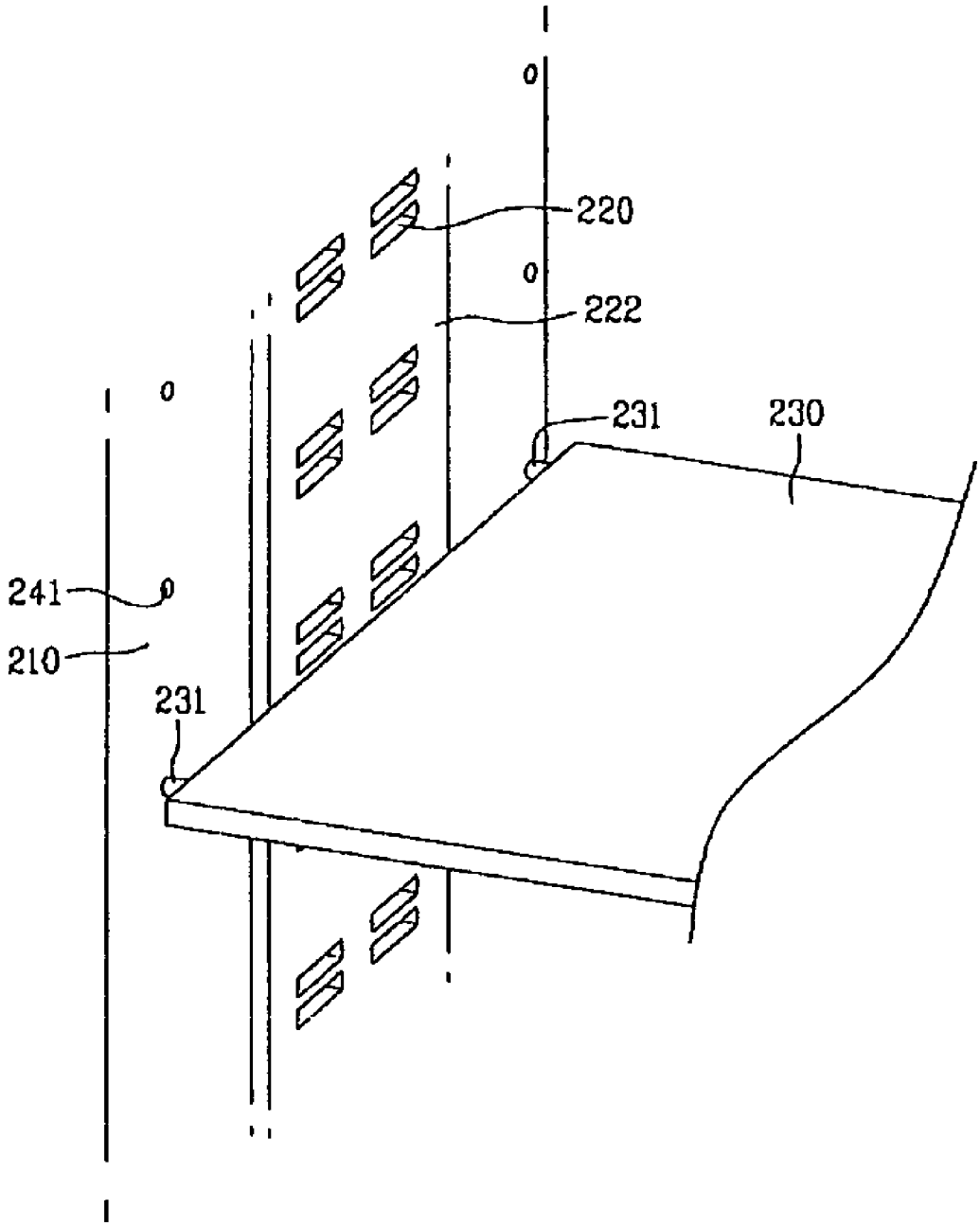
FIG. 5 is a perspective diagram of a support part in a refrigerator according to an embodiment of another embodiment of the present invention.
Figure 6:
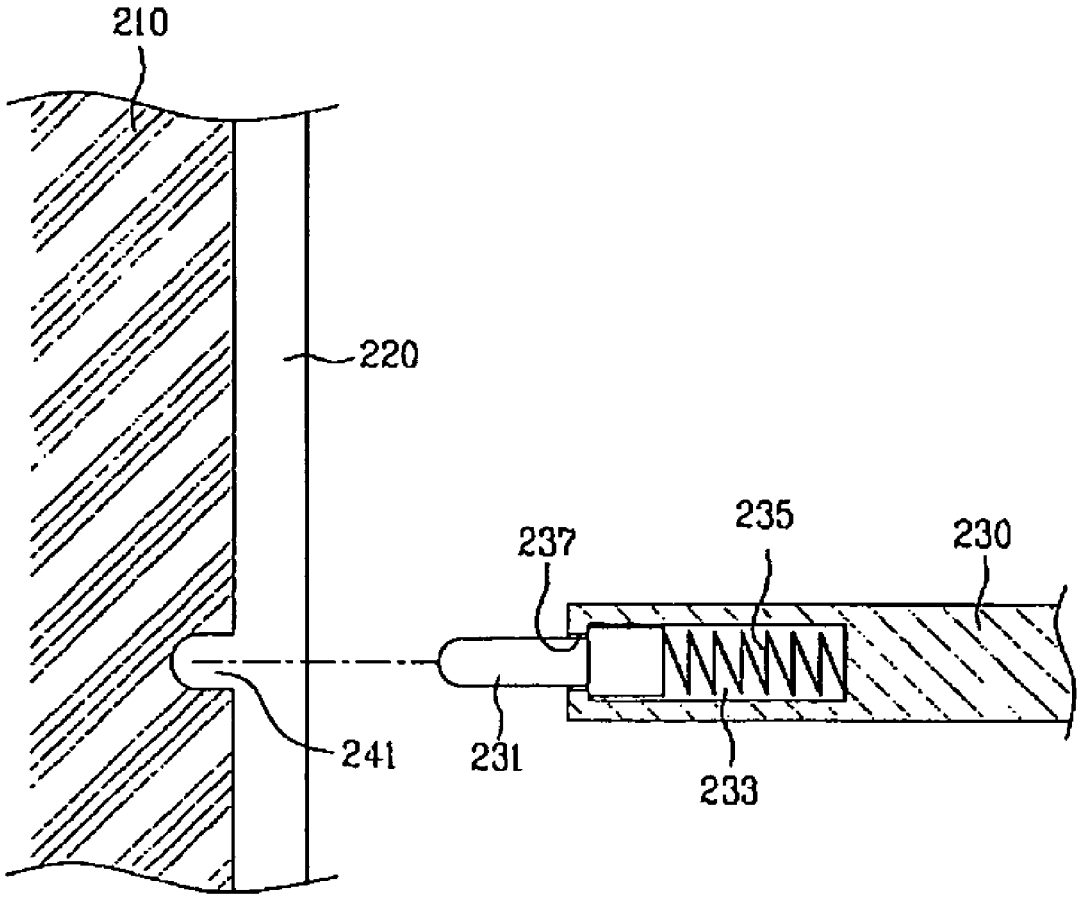
FIG. 6 is a cross-sectional diagram of a support part in a refrigerator according to yet another embodiment of the present invention.

Next, FIG. 5 is a perspective diagram of a support part in a refrigerator according to another embodiment of the present invention, and FIG. 6 is a cross-sectional diagram of a support part in a refrigerator according to another embodiment of the present invention.

Referring to FIG. 5 and FIG. 6, a support part in a refrigerator according to another embodiment of the present invention includes at least one fitting recess 241 configured to have a prescribed depth.

The fitting recess 241 may be provided in the outer wall of the duct part 220. Preferably, the fitting recess 241 is provided in the bulkhead 210. More preferably, at least one pair of the fitting recesses 241 are provided in two opposing sides of the bulkhead 110 in the front-to-rear direction of the refrigerator centering on the duct part 220 to enable the rack 230 to be supported.

Preferably, a plurality of pairs of the fitting recesses 241 are provided in the bulkhead 210 in a vertical direction to correspond to the number of the racks 230 provided within the freezing compartment 107*a* in FIG. 2 or the cool chamber 108*a* in FIG. 2.

In addition, at least one hanging member 231, which is fitted into the corresponding fitting recess 241 to support the corresponding rack 230, is provided in one side portion of the rack to correspond to the at least one fitting recess 241. Preferably, a pair of the hanging members 231 are provided in one side portion of the rack 230 to correspond to a pair of the fitting recesses 241, respectively.

Preferably, at least one receiving recess 233 is provided in the rack 230 to enable the hanging member 231 to move therein to a prescribed length. Thus, one end portion of the hanging member 231 is received in the receiving recess 233, while the other end portion is projected movable from the rack 239.

In particular, an inner diameter of the receiving recess 233 and an outer diameter of the hanging member 231 are configured to correspond to each other. Therefore, the hanging member 232 can be seated movable within the receiving recess 233. In addition, an elastic member 235 is provided in the one end portion of the hanging member 231 received in the receiving recess 233. The elastic member 235 provides a restoring force to enable the moved hanging member 231 to return to its original position.

Further, one end portion of the elastic member 235 is attached to the hanging member 231, while the other end portion of the elastic member 235 is fixed to an inner wall of the receiving recess 233 opposing the hanging member 231. If the hanging member 231 is pushed into the receiving recess 233, the elastic member 235 is compressed to exert the restoring force in a reverse direction. Once the external force is released, the hanging member 231 returns to the original position.

In addition, as shown in FIG. 7, the rack 230 may further include a separation-preventing portion 237 that prevents the hanging member 231 from being separated from the receiving recess 233. For instance, the separation-preventing portion 237 can be configured to protrude toward a diameter center of the receiving recess 233 in a manner that an entrance portion of the receiving recess 233 has a diameter smaller than that of the receiving recess 233.

In this instance, an outer diameter of a portion of the hanging member 231 received in the receiving recess 233 corresponds to an inner diameter of the receiving recess 233, while a portion of the hanging member 231 exposed from the receiving recess 233 is configured to have an outer diameter reduced as long as a size of the separation-preventing portion 237.

Thus, a predetermined portion of the hanging member 231 is unable to escape from the receiving recess 233 by being caught on the separation-preventing portion 237 not to be separated from the receiving recess 233. Further, the fitting recesses 241 are provided in the bulkhead 210 and the inner wall opposing the bulkhead 210. Also, the hanging members 231 are provided to both of the opposing sides of the rack 230. Alternatively, the at least one fitting recess 241 is provided in the bulkhead 210 only and the at least one hanging member explained in the former embodiment of the present invention is provided in an opposing side.

Alternatively, the at least one hanging member explained in the former embodiment of the present invention is provided in the duct part 220 to support the corresponding rack 230 as well as the at least one fitting recess 241. By fitting the hanging member 231 into the corresponding fitting recess 241, the rack 230 can be supported at a prescribed level within the refrigerator 100.

Preferably, the fitting recess 241 is provided at a level to enable the rack 230 to avoid being overlapped with the cold air hole 222. Also, the exposed portion of the hanging member 231 is preferably configured to have a margin length greater than the depth of the fitting recess 241.

If so, in order for a user to install the rack 230, while a pair of the hanging members 231 are inserted into the corresponding fitting recesses 241 provided in one side of the rack 230, another pair of the hanging members 231 provided in the other side of the rack 230 are pushed into the receiving recesses 233 and are then fitted into the other fitting recesses 241 at the opposite side.

In order for a user to detach the rack 230, a pair of the hanging members 231 at one side are pushed into the corresponding receiving recesses 233 to be separated from the fitting recesses 241. The same process is also carried out on the other side. Thus, the rack 230 can be supported by being spaced apart from the bulkhead as long as the protruding portion of the duct part 220.

Accordingly, the present invention provides the following effects or advantages.

First of all, when an evaporator and a cold air duct are provided to a middle bulkhead, rack supports can be installed easily and conveniently. Secondly, the present invention provides rack supports to a duct part, thereby securing rigidity enough to support weight of objects put on a corresponding rack. Thirdly, the present invention enables a rack to be accommodated without being overlapped with a cold air hole provided to a duct, thereby enabling cold air to be efficiently supplied.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A refrigerator, comprising:

a bulkhead partitioning an inner space of the refrigerator;

a duct part provided in the bulkhead to guide cold air to the inner space of the refrigerator;

at least one rack configured to divide the inner space partitioned by the bulkhead into sub-spaces, the at least one rack configured to support an object to be stored;

at least one support part provided in one of the bulkhead and the duct part, the at least one support part configured to support the rack; and at least one cold air hole provided in an outer wall of the duct part to discharge the cold air, wherein the at least one support part includes:

at least one first hanging member provided in the outer wall of the duct part to support one side portion of the rack; and at least one second hanging member provided in the bulkhead to support the one side portion of the rack.

2. The refrigerator of claim 1, further comprising an evaporator provided to the bulkhead to generate the cold air.

3. The refrigerator of claim 2, wherein the duct part is provided over the evaporator.

4. The refrigerator of claim 1, wherein the outer wall of the duct part is configured to protrude outwardly by forming an exterior of the bulkhead in part.

5. The refrigerator of claim 1, wherein the first and second hanging members are configured to substantially form a straight line in a front-to-rear direction of the inner space of the refrigerator.

6. The refrigerator of claim 1, wherein at least one cold air hole is provided between the first hanging members neighboring to each other.

7. The refrigerator of claim 6, further comprising at least one third hanging member provided in an inner wall of the refrigerator opposing the first or second hanging members to support another side portion of the rack.

8. A refrigerator, comprising:

a bulkhead partitioning an inner space of the refrigerator;

a duct part provided in the bulkhead to guide cold air to the inner space of the refrigerator;

at least one rack configured to divide the inner space partitioned by the bulkhead into sub-spaces, the at least one rack configured to support an object to be stored;

at least one support part provided in one of the bulkhead and the duct part, the at least one support part configured to support the rack, and at least one cold air hole provided in an outer wall of the duct part to discharge the cold air, wherein the at least one support part includes at least one fitting recess configured to have a prescribed depth.

9. The refrigerator of claim 8, wherein the at least one fitting recess is provided in the bulkhead.

10. The refrigerator of claim 8, wherein the rack comprises at least one hanging member provided in the one side portion of the rack to correspond to the at least one fitting recess to support the rack by being fitted into the at least one fitting recess.

11. The refrigerator of claim 10, wherein the rack further comprises:

a receiving recess configured to receive the hanging member movable to a prescribed length therein; and an elastic member configured to provide a restoring force to enable the moved hanging member to return to an original position.

12. The refrigerator of claim 11, wherein the rack further comprises a separation-preventing portion configured to prevent the hanging member from being separated from the receiving recess.

13. The refrigerator of claim 8, wherein the fitting recess is configured to support the rack at a level not to be overlapped with the cold air hole.

14. A refrigerator, comprising:

a duct part provided in a bulkhead partitioning an inner space of the refrigerator to guide a cold air to the inner space of the refrigerator;

a plurality of cold air holes provided in an outer wall of the duct part to be spaced apart from each other in a vertical direction and to enable the cold air to be discharged; and at least one hanging member provided in the bulkhead and/or the outer wall of the duct part to enable a rack to be supported between the cold air holes neighboring to each other, wherein an object to be supported is put on the rack, and wherein the hanging member includes:

at least one first hanging member provided in the outer wall of the duct part to support one side portion of the rack; and at least one second hanging member provided in the bulkhead to support the one side portion of the rack.

15. The refrigerator of claim 14, further comprising at least one third hanging member provided in an inner wall of the refrigerator opposing the first or second hanging member to support the other side portion of the rack.

16. The refrigerator of claim 14, wherein the at least one first hanging member is configured to support a rack at a level not to be overlapped with the plurality of cold air holes.

* * * * *